United States Patent [19]

Nishiya

[11] 4,205,491

[45] Jun. 3, 1980

[54] VIBRATION BARREL GRINDING DEVICE

[75] Inventor: Mitsuo Nishiya, Yokohama, Japan

[73] Assignee: Ietatsu Ohno, Tokyo, Japan

[21] Appl. No.: 947,204

[22] Filed: Sep. 29, 1978

[51] Int. Cl.[2] ..... B24B 31/06

[52] U.S. Cl. ..... 51/163.2

[58] Field of Search ..... 51/163.2, 7; 241/172, 241/175

[56] References Cited

U.S. PATENT DOCUMENTS

| | | | |
|---|---|---|---|
| 101,431 | 4/1870 | Chambers | 51/7 |
| 2,480,238 | 8/1949 | Hammond | 51/7 |
| 3,400,495 | 9/1968 | Balz | 51/163.2 |
| 3,464,674 | 9/1969 | Pick | 51/163.2 |

FOREIGN PATENT DOCUMENTS

| | | | |
|---|---|---|---|
| 379370 | 7/1973 | U.S.S.R. | 51/163.2 |

*Primary Examiner*—Harold D. Whitehead

*Attorney, Agent, or Firm*—Laurence R. Brown

[57] ABSTRACT

A vibration barrel grinding device particularly for light articles wherein the outer peripheral wall of a vibration barrel having a circular or polygonal grinding tub or a toroidal-shaped tub is formed of a pressurized flow wall and a pressured riser wall. A cylindrical core is provided as fixed or rotatable along the inner peripheral wall of the barrel and a proper number of blades are provided as inclined downward on the peripheral surface of the cylindrical core so that the flow of a mass may be forcibly moved downward to improve the grinding efficiency.

3 Claims, 4 Drawing Figures

VIBRATION BARREL GRINDING DEVICE

BACKGROUND OF THE INVENTION

1. Field of the Invention

The present invention relates to vibration barrel grinding devices and more particularly to a vibration barrel grinding device adapted to grind light work articles.

2. Description of the Prior Art

In a conventional toroidal-shaped vibration barrel grinding device, as shown in FIG. 1, a mass contained in the toroidal-shaped barrel tub 1 resonates with a forcible rotary vibration given to the arcuate bottom wall 1*a* of the barrel tub 1 so as to be forcibly made to rise as indicated by the arrow "a" toward the outer peripheral wall 1*b* from the arcuate bottom wall 1*a* and the thus elevated mass flows as indicated by the arrow "b" in the drawing toward the inner peripheral wall 1*c* of the barrel tube 1 and rotates while flowing to the arcuate bottom wall 1*a* of the barrel tube 1.

Such rotary motion of the mass in the barrel tub is given by rotating an upper weight 3*a* and bottom weight 3*b* fitted to both ends of a motor 2 so as to strongly vibrate the barrel tub 1 mounted on springs 5 on a mount 4. Therefore, the strong vibration given to the barrel tub 1 will be transmitted to the mass within the barrel tub and will forcibly rotate the mass so as to generate a mutual motion having a mutual contact pressure between a grinding material and a work article in the mass to grind the work. If the respective weights 3*a* and 3*b* fixed to the shaft of the motor 2 are made to have any advance angle, the mass will rotate and flow in the direction indicated by the arrow c in the barrel tub while spirally rotating as indicated by the solid line arrow in FIG. 2 so as to grind the work. However, there have been defects that, in case the work to be ground is a comparatively light article, is forcibly made to rise as indicated by the arrow a toward the outer peripheral wall 1*b* of the barrel tub 1 and flows toward the inner peripheral wall 1*c*, it will float up out of the grinding material, will not submerge into the grinding material, therefore will not be ground and will reduce the grinding efficiency.

SUMMARY OF THE INVENTION

An object of the present invention is to provide a vibration barrel grinding device wherein the above mentioned defects are eliminated and particularly even light articles can be well ground.

DETAILED DESCRIPTION OF PREFERRED EMBODIMENTS

Figure 1:
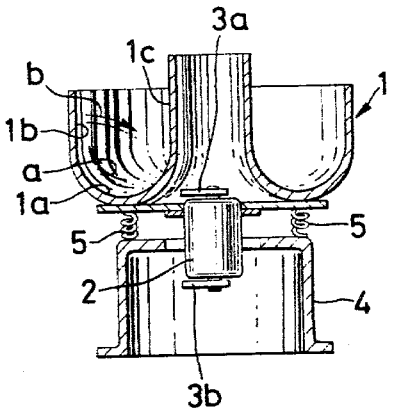
FIG. 1 PRIOR ART
FIG. 1 is a vertically sectioned elevation of a conventional vibration barrel grinding device.
Figure 2:
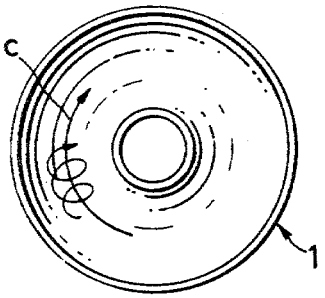
FIG. 2 PRIOR ART
FIG. 2 is a plan view of FIG. 1.
Figure 3:
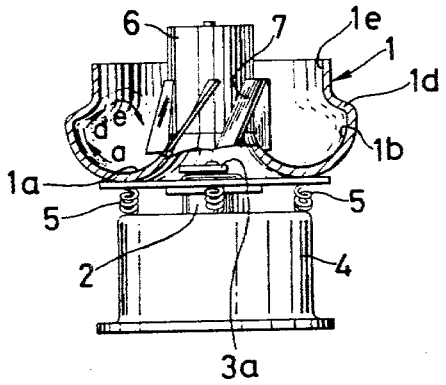
FIG. 3 is a partly sectioned elevation showing an embodiment of a vibration barrel grinding device of the present invention.
Figure 4:
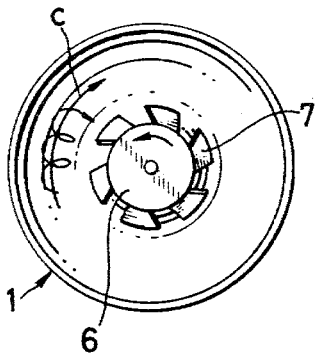
FIG. 4 is a plan view of FIG. 3.

FIG. 3 is a partly sectioned elevation showing an embodiment of a grinding device of the present invention. FIG. 4 is a plan view of the same. The same reference numerals are attached to the same parts as in FIGS. 1 and 2. In the drawings, the outer peripheral wall of a barrel tub has a pressured flow wall 1*d* extending upward inside and a substantially vertically extending pressured riser wall. The reference "d" indicates a pressured direction of a grinding flow and "e" indicates a flowing direction of the grinding by the pressure. Due to the forcible motion, the flow will pass in the direction indicated by the arrow "a" from the arcuate bottom wall 1*a* in the tub and will rise in the direction of 1*b*. At this time, by the formation of the pressured flow wall 1*d*, the grinding flow will be pressured in the direction indicated by the arrow "d". A strong friction flow will be produced by this pressuring action and a strong grinding will be obtained. As different from the flow in FIG. 1 of the conventional method, as shown in FIG. 3 of the present invention, the flow will rise to a high position on the upper surface of the tub and will then rotate and flow to a high position of 1*d*. Therefore naturally the grinding will be effective, the working will be efficient and a strong grinding previously impossible will be possible. 6 is a cylindrical core rotatably provided along an inner peripheral wall 1*c* as shown in the conventional barrel grinding device of FIG. 1. A proper number of blades 7 are fitted as inclined downward to the peripheral surface of this cylindrical core. The direction of the inclination is the rotating and flowing direction (indicated by the arrow c in FIG. 2) of the mass. The cylindrical core 6 may be rotated by a motor 2 provided in the center space of the barrel tub 1 or by any different method.

In such apparatus, if the mass is rotating and flowing in the direction indicated by the arrow c in the barrel tub 1 while spirally rotating as indicated by the solid line arrow as shown in FIG. 4, the cylindrical core b will be rotated in the reverse direction or the same direction as required. Then, due to the inclined surfaces of the blades 7 of this cylindrical core 6, a pressure will act in the direction of pushing in the grinding material and the work to be ground and therefore the work which has floated up will again submerge into the grinding material due to the blades 7, and will be forcibly made to rise toward the outer peripheral wall 1*b* from the arcuate bottom wall 1*a* so as to be ground. The contour and inclination angle of the blade 7 can be freely selected in response to the object. Further, it is not particularly necessary to rotate the cylindrical core. Even if the core is stationary, the mass will move along the inclined surfaces of the blades 7 and therefore the work to be ground will submerge into the mass.

As explained above, according to the device of the present invention, as the downward forcible movement on the inner peripheral wall is further added to the spirally rotating flow effected by the vibrating barrel, the agitating friction flow of the work to be ground with the grinding material will become high, the grinding efficiency will be very high particularly, in case the work is light.

I claim:

1. The improvement in a vibration barrel grinding device having a toroidal-shaped grinding tub in which vibrating means effects a rotary flow pattern of a mass within the tub about the toroidal tub while spirally rotating along that rotary flow pattern, comprising the provision in the center of the grinding tub of blade structure having at least one projecting blade inclined downwardly along the toroidal tub wall and inclined in the rotary flow direction of the mass to forcibly submerge and direct the mass downwardly at the center of the toroid and upwardly against the outer torodial tub wall to provide a rotary and spiral movement force supplemental to that imparted by said vibration and thus more efficiently grind work materials particularly light weight materials.

2. The improvement defined in claim 1 wherein the blade structure comprises a set of blades positioned on a core member relatively movable to the toroidal tub.

3. The improvement defined in claim 1 wherein the toroidal tub has from its outer periphery an abruptly inwardly extending wall portion exerting a pressure upon the upwardly flowing mass.

* * * * *